US006733373B1

(12) United States Patent
Yang et al.

(10) Patent No.: US 6,733,373 B1
(45) Date of Patent: May 11, 2004

(54) POLISHING ASSEMBLY FOR A LINEAR CHEMICAL MECHANICAL POLISHING APPARATUS AND METHOD FOR FORMING

(75) Inventors: Chia-Ming Yang, Hsin-Chu (TW); Chin-Hsin Peng, Hsin-Chu (TW); Jian-Lin Hwang, Hsin-Chu (TW); Ying-Ho Chen, Taipei (TW)

(73) Assignee: Taiwan Semiconductor Manufacturing Co., Ltd., Hsin Chu (TW)

( * ) Notice: Subject to any disclaimer, the term of this patent is extended or adjusted under 35 U.S.C. 154(b) by 0 days.

(21) Appl. No.: 09/540,326

(22) Filed: Mar. 31, 2000

(51) Int. Cl.[7] ..... B24B 21/00
(52) U.S. Cl. ..... 451/296; 451/531
(58) Field of Search ..... 451/41, 296, 303, 451/526, 529, 531

(56) References Cited

U.S. PATENT DOCUMENTS 3,637,359 A * 1/1972 Malloy ..... 51/298
4,008,545 A * 2/1977 Koide et al. ..... 451/70
4,027,435 A * 6/1977 Malloy ..... 51/295
5,256,227 A * 10/1993 Roelofs ..... 156/157
5,722,877 A * 3/1998 Meyer et al. ..... 451/41
6,261,168 B1 * 7/2001 Jensen et al. ..... 451/527
6,315,857 B1 * 11/2001 Cheng et al. ..... 156/345

* cited by examiner

*Primary Examiner*—Dung Van Nguyen
(74) *Attorney, Agent, or Firm*—Tung & Associates

(57) ABSTRACT

A polishing assembly for use in a linear chemical mechanical polishing apparatus and a method for forming such assembly are described. In the polishing assembly, a plurality of polishing pads are adhesively joined to a top surface of a continuous belt. Each of the plurality of polishing pads is provided with a leading edge which has a lower lip and a trailing edge which has an upper lip. The upper lip of the trailing edge of a first polishing pad covers the lower lip of the leading edge of a second polishing pad when the pads are adhesively bonded to the continuous belt such that the first pad leads the second pad in the direction of rotation for the continuous belt such that the upper lip protects the lower lip to prevent delamination of the pads. The tight seam made possible by the present invention novel tapered joint further prevents water absorption or penetration and therefore prolongs the lifetime of the polishing pads.

13 Claims, 2 Drawing Sheets

POLISHING ASSEMBLY FOR A LINEAR CHEMICAL MECHANICAL POLISHING APPARATUS AND METHOD FOR FORMING

FIELD OF THE INVENTION

The present invention generally relates to a polishing assembly for use in a polishing process and a method for forming the assembly and more particularly, relates to a polishing assembly for use in a linear chemical mechanical polishing apparatus wherein a plurality of polishing pads are adhesively joined to a continuous belt and a method for forming the polishing assembly.

BACKGROUND OF THE INVENTION

In the fabrication of semiconductor devices from a silicon wafer, a variety of semiconductor processing equipment and tools are utilized. One of these processing tools is used for polishing thin, flat semiconductor wafers to obtain a planarized surface. A planarized surface is highly desirable on a shadow trench isolation (STI) layer, on an inter-layer dielectric (ILD) or on an inter-metal dielectric (IMD) layer which are frequently used in memory devices. The planarization process is important since it enables the use of a high resolution lithographic process to fabricate the next level circuit. The accuracy of a high resolution lithographic process can be achieved only when the process is carried out on a substantially flat surface. The planarization process is therefore an important processing step in the fabrication of semiconductor devices.

A global planarization process can be carried out by a technique known as chemical mechanical polishing or CMP. The process has been widely used on ILD or IMD layers in fabricating modern semiconductor devices. A CMP process is performed by using a rotating platen in combination with a pneumatically actuated polishing head. The process is used primarily for polishing the front surface or the device surface of a semiconductor wafer for achieving planarization and for preparation of the next level processing. A wafer is frequently planarized one or more times during a fabrication process in order for the top surface of the wafer to be as flat as possible. A wafer can be polished in a CMP apparatus by being placed on a carrier and pressed face down on a polishing pad covered with a slurry of colloidal silica or aluminum.

A polishing pad used on a rotating platen is typically constructed in two layers overlying a platen with a resilient layer as an outer layer of the pad. The layers are typically made of a polymeric material such as polyurethane and may include a filler for controlling the dimensional stability of the layers. A polishing pad is typically made several times the diameter of a wafer, in a conventional rotary CMP, while the wafer is kept off-center on the pad in order to prevent polishing a non-planar surface onto the wafer. The wafer itself is also rotated during the polishing process to prevent polishing a tapered profile onto the wafer surface. The axis or rotation of the wafer and the axis of rotation of the pad are deliberately not collinear, however, the two axes must be parallel. It is known that uniformity in wafer polishing by a CMP process is a function of pressure, velocity and concentration of the slurry used.

A CMP process is frequently used in the planarization of an ILD or IMD layer on a semiconductor device. Such layers are typically formed of a dielectric material. A most popular dielectric material for such usage is silicon oxide. In a process for polishing a dielectric layer, the goal is to remove typography and yet maintain good uniformity across the entire wafer. The amount of the dielectric material removed is normally between about 5000 Å and about 10,000 Å. The uniformity requirement for ILD or IMD polishing is very stringent since non-uniform dielectric films lead to poor lithography and resulting window etching or plug formation difficulties. The CMP process has also been applied to polishing metals, for instance, in tungsten plug formation and in embedded structures. A metal polishing process involves a polishing chemistry that is significantly different than that required for oxide polishing.

The important: component needed in a CMP process is an automated rotating polishing platen and a wafer holder, which both exert a pressure on the wafer and rotate the wafer independently of the rotation of the platen. The polishing or the removal of surface layers is accomplished by a polishing slurry consisting mainly of colloidal silica suspended in deionized water or KOH solution. The slurry is frequently fed by an automatic slurry feeding system in order to ensure the uniform wetting of the polishing pad and the proper delivery and recovery of the slurry. For a high volume wafer fabrication process, automated wafer loading/unloading and a cassette handler are also included in a CMP apparatus.

As the name implies, a CMP process executes a microscopic action of polishing by both chemical and mechanical means. While the exact mechanism for material removal of an oxide layer is not known, it is hypothesized that the surface layer of silicon oxide is removed by a series of chemical reactions which involve the formation of hydrogen bonds with the oxide surface of both the wafer and the slurry particles in a hydrogenation reaction; the formation of hydrogen bonds between the wafer and the slurry; the formation of molecular :bonds between the wafer and the slurry; and finally, the breaking of the oxide bond with the wafer or the slurry surface when the slurry particle moves away from the wafer surface. It is generally recognized that the CMP polishing process is not a mechanical abrasion process of slurry against a wafer surface.

While the CMP process provides a number of advantages over the traditional mechanical abrasion type polishing process, a serious drawback for the CMP process is the difficulty in controlling polishing rates and different locations on a wafer surface. Since the polishing rate applied to a wafer surface is generally proportional to the relative velocity of the polishing pad, the polishing rate,at a specific point on the wafer surface depends on the distance from the axis of rotation. In other words, the polishing rate obtained at the edge portion of the wafer that is closest to the rotational axis of the polishing pad is less than the polishing rate obtained at the opposite edge of the wafer. Even though this is compensated by rotating the wafer surface during the polishing process such that a uniform average polishing rate can be obtained, the wafer surface, in general, is exposed to a variable polishing rate during the CMP process.

More recently, a new chemical mechanical polishing method has been developed in which the polishing pad is not moved in a rotational manner but instead, in a linear manner. It is therefor named as a linear chemical mechanical polishing process in which a polishing pad is moved in a linear manner in relation to a rotating wafer surface. The linear polishing method affords a uniform polishing rate across a wafer surface throughout a planerization process for uniformly removing a film player of the surface of a wafer. One added advantage of the linear CMP system is the simpler construction of the apparatus and therefore not only reducing the cost of the apparatus but also reduces the floor space required in a clean room environment.

A typical linear CMP apparatus 10 is shown in FIGS. 1A and 1B. The linear CMP apparatus 10 is utilized for polishing a semi-conductor wafer 24, i.e. a silicon wafer for removing a film layer of either an insulating material or a wafer from the wafer surface. For instance, the film layer to be removed may include insulating materials such as silicon oxide, silicon nitrite or spin-on-glass material or a metal layer such as aluminum, copper or tungsten. Various other materials such as metal alloys or semi-conducting materials such as polysilicon may also be removed.

As shown in FIGS. 1A and 1B, the wafer 24 is mounted on a rotating platform, or wafer holder 18 which rotates at a predetermined speed. The major difference between the linear polisher 10 and a conventional CMP is that a continuous, or endless belt 12 is utilized instead of a rotating polishing pad. The belt 12 moves in a linear manner in respect to the rotational surface of the wafer 24. The linear belt 12 is mounted in a continuous manner over a pair of rollers 14 which are, in turn, driven by a motor means (not shown) at a pre-determined rotational speed. The rotational motion of the rollers 14 is transformed into a linear motion 26 in respect to the surface of the wafer 24. This is shown in FIG. 1B.

In the linear polisher 10, a polishing pad 30 is adhesively joined to the continuous belt 12 on its outer surface that faces the wafer 24. A polishing assembly 38 is thus formed by the continuous belt 12 and the polishing pad 30 glued thereto. As shown in FIG. 1A, a plurality of polishing pads 30 are utilized which are frequently supplied in rectangular-shaped pieces with a pressure sensitive layer coated on the back side.

The wafer platform 18 and the wafer 24 forms an assembly of a wafer carrier 28. The wafer 24 is normally held in position by a mechanical retainer, commonly known as a retaining ring 16, as shown in FIG. 1B. The major function of the retaining ring 16 is to fix the wafer in position in the wafer carrier 28 during the linear polishing process and thus preventing the wafer from moving horizontally as wafer 24 contacts the polishing pad 30. The wafer carrier 28 is normally operated in a rotational mode such that a more uniform polishing on wafer 24 can be achieved. To further improve the uniformity of linear polishing, a support housing 32 is further utilized to provide support to support platen 22 during a polishing process. The support platen 22 provides a supporting platform for the underside of the continuous belt 12 to ensure that the polishing pad 30 makes sufficient contact with the surface of wafer 24 in order to achieve more uniform removal in the surface layer. Typically, the wafer carrier 28 is pressed downwardly against the continuous belt 12 and the polishing pad 30 at a predetermined force such that a suitable polishing rate on the surface of wafer 24 can be obtained. A desirable polishing rate on the wafer surface can therefore by obtained by suitably adjusting forces on the support housing 32, the wafer carrier 28, and the linear speed 26 of the polishing pad 30. A slurry dispenser 20 is further utilized to dispense a slurry solution 34.

In the conventional linear polisher 10, the polishing pads 30 are joined to the continuous belt 12 by adhesive means such as by a pressure sensitive. In a typical linear polisher, since the continuous belt 12 may have a length of about 240 cm, while the polishing pads 30 cannot be supplied in the form of a continuous manner, many pieces of the polishing pads 30 must be used. In other words, seam lines between adjacent polishing pads 30 must be formed when joined to the continuous belt 12. For instance, when the polishing pads are supplied in length of only about 30~40 cm, between five and seven pieces of the polishing pads must be utilized. The seam lines between the pads in turn cause several processing difficulties such as shortened lifetime of the polishing pads due to water absorption through the seam lines, polishing head compression and abrasion of the diamond conditioning disc.

Particularly, the water absorption problem or the different water absorption constants of the polishing pad and the continuous belt deteriorates the lifetime of the pads. It is not uncommon that a gap as large as 5 mm can be found at the seam line between the polishing pads. The gap between the polishing pads further deteriorates the water absorption problem and thus leads to the delamination of the pads from the continuous belt after prolonged usage. It is desirable to solve the water absorption problem by improving the seam between the polishing pads such that the lifetime of the polishing pads can be extended.

It is therefore an object of the present invention to provide a polishing assembly for a linear polisher that does not have the drawbacks or shortcomings of the polishing assembly used in conventional linear polishers.

It is another object of the present invention to provide a polishing assembly formed of a continuous belt and a plurality of polishing pads that has improved lifetime when used in a linear polisher.

It is a further object of the present invention to provide a polishing assembly that can be used with improved lifetime in a linear chemical mechanical polishing apparatus.

It is another further object of the present invention to provide a polishing assembly that is formed of a continuous belt and a plurality of polishing pads that does not have gaps at the seam lines between the pads.

It is still another object of the present invention to provide a polishing assembly for use in a linear polisher wherein a plurality of polishing pads are adhesively joined to a continuous belt without water absorption problem.

It is yet another object of the present invention to provide a polishing assembly for use in a linear polisher wherein a plurality of polishing pads each having a tapered end for forming a tight joint with adjacent pad is utilized.

It is still another further object of the present invention to provide a method for bonding a plurality of polishing pads to an endless belt for use in a linear chemical mechanical polishing apparatus that does not have a shortened lifetime because of water absorption into the pads.

It is yet another object of the present invention to provide a method for bonding a plurality of polishing pads each having a tapered end to a continuous belt forming tight seams with adjacent pads such that delamination of polishing pads from the belt due to water absorption can be avoided.

SUMMARY OF THE INVENTION

In accordance with the present invention, a polishing assembly for a linear chemical mechanical polishing apparatus and a method for forming the polishing assembly are provided.

In a preferred embodiment, a polishing assembly for a linear chemical mechanical polishing apparatus is provided which includes a continuous belt mounted on a pair of rollers, a pair of rollers for supporting and rotating the continuous belt, a motor means for rotating at least one of the pair of rollers, and a plurality of polishing pads adhesively joined to a top surface of and to substantially cover the continuous belt, each of the plurality of polishing pads is provided with a leading edge and a trailing edge both formed in a tapered shape such that the leading edge has a lower lip and the trailing edge has an upper lip and that the upper lip of the trailing edge of the first pad covers the lower lip of the leading edge of a second pad when both pads are adhesively joined to the continuous belt when the first pad leads the second pad in the direction of rotation of the continuous belt.

In the polishing assembly for a linear polisher, a combined thickness of the upper lip and the lower lip substantially equals to a thickness of the polishing pad, the plurality of polishing pads may be formed of a polymeric material, while the polishing assembly may further include slurry dispensing means and/or a pad conditioning means. The tapered shape may include a sloped surface that has a slope between 10° and 60° as measured from a plane of the polishing pad. The plurality of polishing pads is joined to the top surface of the continuous belt by a layer of pressure-sensitive adhesive. The continuous belt may be rotated by the pair of rollers to a speed between 50 ft/min and 500 ft/min. The plurality of polishing pads may include at least four polishing pads. The sloped surface may have a slope between 40° and 50° as measured from a plane of the polishing pad.

The present invention is further directed to a method for bonding a plurality of polishing pads to an endless belt for use in a linear chemical mechanical polishing apparatus which can be carried out by the operating steps of providing an endless belt mounted on a pair of rollers, providing a plurality of polishing pads each having a leading edge and a trailing edge both formed in a tapered shape such that the leading edge has a lower lip and the trailing edge has an upper lip, and bonding the plurality of polishing pads by adhesive means to a top surface of the endless belt such that the upper lip of the trailing edge of a first polishing pad covers the lower lip of the leading edge of the second polishing pad when the first pad leads the second pad in a direction of rotation for the endless belt.

The method for bonding a plurality of polishing pads to an endless belt for use in a linear polisher may further include the step of providing a motor means for rotating at least one of the pair of rollers. The method may further include the step of connecting a motor means to at least one of the pair of rollers for rotating the endless belt. The method may further include the step of rotating the endless belt at a speed between 50 ft/min and 500 ft/min. The method may further include the step of bonding the plurality of polishing pads to a top surface of the endless belt by a pressure-sensitive adhesive. The method may further include the step of forming the leading edge and the trailing edge in a taper that has a slope of between 10° and 60° as measured from a plane of the polishing pad, or preferably forming the slope between 40° and 50° as measured from a plane of the polishing pad. The method may further include the step of rotating the endless belt at a speed preferably between 50 ft/min and 150 ft/min.

BRIEF DESCRIPTION OF THE DRAWINGS

In the drawings, which form an integral part of the specifications, and are to be read in conjunction therewith, and in which like components are designated by identical numerals in the various views.

DETAILED DESCRIPTION OF THE PREFERRED EMBODIMENT

The present invention discloses a polishing assembly for use in a linear chemical mechanical polishing apparatus in which a plurality of polishing pads are adhesively bonded to a continuous belt that is mounted on a pair of rollers. Each of the plurality of polishing pads is provided with a leading edge and a trailing edge that are formed in a tapered shape such that the leading edge has a lower lip and the trailing edge has an upper lip. When the present invention polishing pads are joined together on a continuous belt, the upper lip of the trailing edge of a first pad covers the lower lip of the leading edge of a second polishing pad in an arrangement such that the first pad always leads the second pad in the direction of rotation for the continuous belt. During rotation of the continuous belt and the polishing pads adhesively joined on top, the upper lip of a first pad always protects the lower lip of a second pad in the direction of rotation such that any possibility of delamination caused by water absorption is eliminated.

In the present invention novel polishing pads, a combined thickness of the upper lip and the lower lip is substantially equal to a thickness of the polishing pad. The tapered shape in the leading edge and the trailing edge of the pad may include a sloped surface that has an angle between about 10° and about 60° when measured from a plane of the polishing pad. By "about", it is meant a value of ±10% from the average value given. Preferably, the sloped surface may have an angle between about 40° and about 50° as measured from a plane of the polishing pad. The tight joint formed by an upper lip and a lower lip of two adjoining pads effectively prevents the formation of a gap thereinbetween and possible water absorption into the pads leading to lamination. The water absorption problem can be caused by the water based slurry that is frequently used in the chemical mechanical polishing process.

Figure 1A:
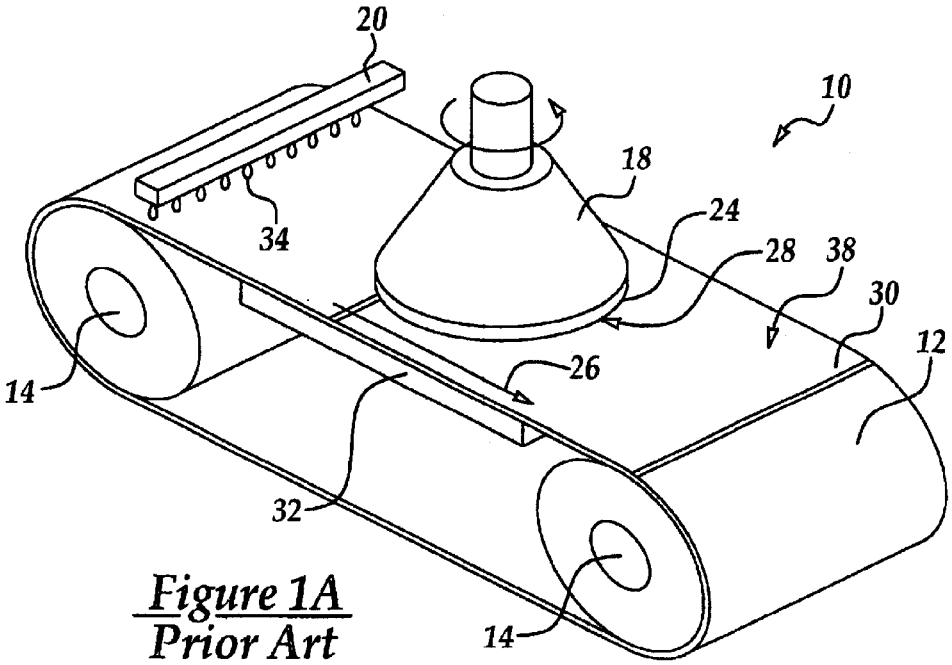
Figure 1A Prior Art
FIG. 1A is a prospective view of a conventional linear chemical mechanical polishing apparatus utilizing a continuous belt.
Figure 1B:
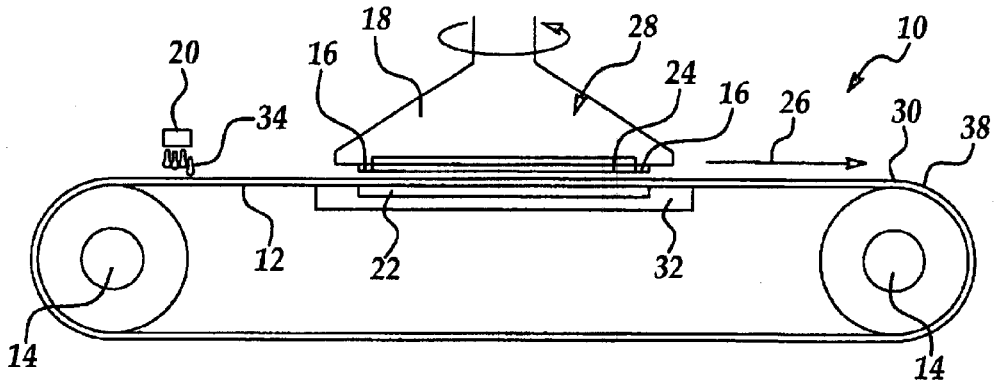
Figure 1B Prior Art
FIG. 1B is a side view of the conventional linear chemical mechanical polishing apparatus of FIG. 1A.
Figure 2A:
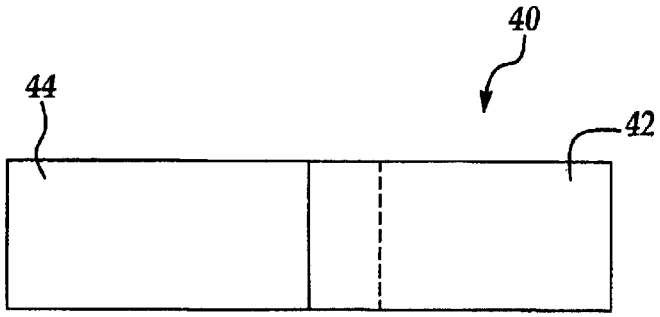
FIG. 2A is a plane view of two polishing pads joined together in the present invention, polishing assembly.
Figure 2B:
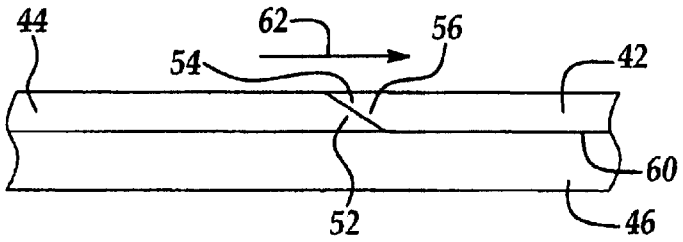
FIG. 2B is a side view of the polishing pads of FIG. 2A joined to a continuous belt.

Referring now to FIG. 2A wherein a plane view of a partial present invention polishing assembly 40 is shown. The polishing assembly 40 is formed by polishing pads 42, 44 which are adhesively joined to a continuous belt 46, as shown in FIG. 2B. In the configuration shown in FIGS. 2A, 2B and 2C, the slope of the taper in the leading edge 48 and trailing edge 50 is about 45°. The leading edge 48 of polishing pad 44 has a lower lip 52, while the trailing edge 50 of polishing pad 42 has an upper lip 54. The polishing pads 42, 44 are joined to the continuous belt 46 by an adhesive layer 60, i.e. such as a pressure sensitive adhesive.

Figure 2C:
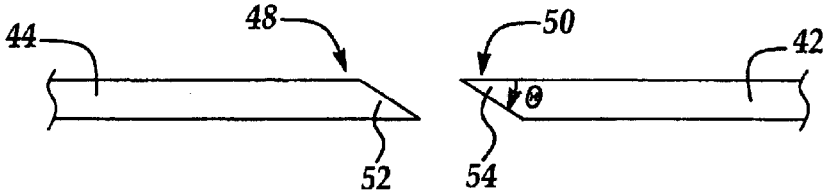
FIG. 2C is a cross-sectional view of a first preferred embodiment of the tapered edge of the polishing pads.

In the first embodiment of the present invention, shown in FIGS. 2A–2C, in the rotational direction 62 of the continuous belt 46, the upper lip 54 of the trailing edge 50 covers the lower lip 52 of the leading edge 48 such that the lower lip 52 is always protected from delamination either by the mechanical abrasion of wafer (not shown) on top or by water absorption into the seam 56 between polishing pads 42, 44. Since a tight seam 56 is formed between the two polishing pads 42, 44, there is no gap to allow water penetration and absorption.

Figure 3:
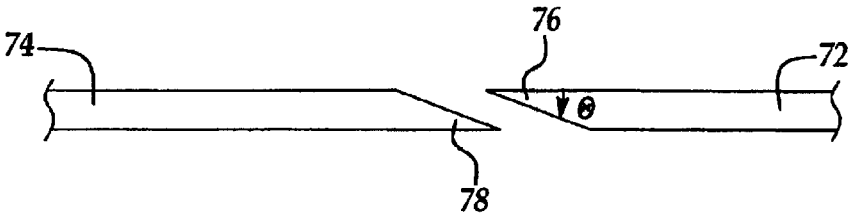
FIG. 3 is a cross-sectional view of a second preferred embodiment of the present invention polishing pads with a tapered edge.
Figure 4:
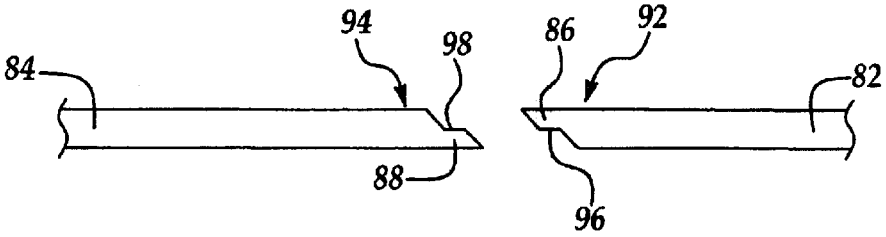
FIG. 4 is a cross-sectional view of a third preferred embodiment of the present invention polishing pads with a tapered edge in a step form.

In a second embodiment of the present invention, shown in FIG. 3, a smaller angle ø of about 30° is utilized in polishing pads 72, 74. Similar to the first embodiment shown in FIG. 2C, the upper lip 76 and the lower lip 78 forms a tight seam (not shown) when the two pads 72, 74 are adhesively joined to a continuous belt. In still another embodiment shown in FIG. 4, polishing pads 82, 84 is each equipped with an upper lip 86 and a lower lip 88, respectively. The tapered surface of the trailing edge 92 and the leading edge 94 is different than that shown in the previous two embodiments, i.e. in a step shape with steps 96, 98 to further facilitate the forming of a tight seam.

The present invention has therefore been amply described in the above description and in the appended drawings of FIGS. 2A~4. It should be noted that while three different embodiments of the present invention tapered surface on the leading edge and trailing edge of a polishing pad have been shown, there is an unlimited number of other variations that can be utilized to achieve the same desirable results of the present invention.

While the present invention has been described in an illustrative manner, it should be understood that the terminology used is intended to be in a nature of words of description rather than of limitation.

Furthermore, while the present invention has been described in terms of three preferred embodiments, it is to be appreciated that those skilled in the art will readily apply these teachings to other possible variations of the inventions.

The embodiments of the invention in which an exclusive property or privilege is claimed are defined as follows:

What is claimed is:

1. A polishing assembly for a linear chemical mechanical polishing apparatus comprising:

a continuous belt mounted on a pair of rollers;

a pair of rollers for supporting and rotating said continuous belt;

a motor means for rotating at least one of said pair of rollers to a speed between about 50 ft/min and about 150 ft/min; and a plurality of polishing pads adhesively joined to a top surface to substantially cover said continuous belt, each of said plurality of polishing pads being provided with a leading edge and a trailing edge both formed in a tapered shape such that the leading edge has a lower lip and the trailing edge has an upper lip wherein a combined thickness of said upper lip and said lower lip substantially equals a thickness of said polishing pad, the upper lip of the trailing edge of a first pad covers the lower lip of the leading edge of a second pad when both pads are adhesively jointed to the continuous belt and when the first pad leads the second pad in the direction of rotation of the continuous belt.

2. A polishing assembly for a linear chemical mechanical polishing apparatus according to claim 1, wherein said plurality of polishing pads is formed of a polymeric material.

3. A polishing assembly for a linear chemical mechanical polishing apparatus according to claim 1, wherein said polishing assembly further comprises slurry dispensing means.

4. A polishing assembly for a linear chemical mechanical polishing apparatus according to claim 1, wherein said tapered shape comprises a sloped surface having a slope between about 10° and about 60° as measured from a plane of the polishing pad.

5. A polishing assembly for a linear chemical mechanical polishing apparatus according to claim 4, wherein said sloped surface having a slope between about 40° and about 50° as measured from a plane of the polishing pad.

6. A polishing assembly for a linear chemical mechanical polishing apparatus according to claim 1, wherein said plurality of polishing pads is joined to said top surface of said continuous belt by a layer of pressure-sensitive adhesive.

7. A polishing assembly for a linear chemical mechanical polishing apparatus according to claim 1, wherein said plurality of polishing pads comprises at least four polishing pads.

8. A method for bonding a plurality of polishing pads to an endless belt for use in a linear chemical mechanical polishing apparatus comprising the steps of:

providing an endless belt mounted on a pair of rollers;

providing a plurality of polishing pads each having a leading edge and a trailing edge both formed in a tapered shape such that the leading edge has a lower lip and the trailing edge has an upper lip;

bonding said plurality of polishing pads by adhesive means to a top surface of said endless belt such that the upper lip of the trailing edge of a first polishing pad covers the lower lip of the leading edge of a second polishing pad such that a combined thickness of said upper lip and said lower lip substantially equals a thickness of said polishing pad, the first pad leads the second pad in a direction of rotation for the endless belt; and rotating said endless belt at a speed between about 50 ft/min and about 150 ft/min.

9. A method for bonding a plurality of polishing pads to an endless belt for use in a linear chemical mechanical polishing apparatus according to claim 8 further comprising the step of providing a motor means for rotating at least one of said pair of rollers.

10. A method for bonding a plurality of polishing pads to an endless belt for use in a linear chemical mechanical polishing apparatus according to claim further comprising the step of connecting a motor means to at least one of said pair of rollers for rotating said endless belt.

11. A method for bonding a plurality of polishing pads to an endless belt for use in a linear chemical mechanical polishing apparatus according to claim 8 further comprising the step of bonding said plurality of polishing pads to a top surface of the endless belt by a pressure-sensitive adhesive.

12. A method for bonding a plurality of polishing pads to an endless belt for use in a linear chemical mechanical polishing apparatus according to claim 8 further comprising the step of forming said leading edge and said trailing edge in a taper having a slope of between about 10° and about 60° as measured from a plane of the polishing pad.

13. A method for bonding a plurality of polishing pads to an endless belt for use in a linear chemical mechanical polishing apparatus according to claim 8 further comprising the step of forming said leading edge and said trailing edge in a taper having a slope of between about 40° and about 50° as measured from a plane of the polishing pad.

* * * * *